US006325656B1

(12) United States Patent
Fukuda et al.

(10) Patent No.: US 6,325,656 B1
(45) **Date of Patent: *Dec. 4, 2001**

(54) LOCK STRUCTURE FOR LOCKING MALE AND FEMALE CONNECTOR HOUSINGS TOGETHER

(75) Inventors: Masaru Fukuda; Hideki Ohsumi, both of Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/283,145

(22) Filed: Apr. 1, 1999

(30) Foreign Application Priority Data

Apr. 2, 1998 (JP) ..... 10-090420

(51) Int. Cl.[7] ..... H01R 13/627
(52) U.S. Cl. ..... 439/358; 439/358
(58) Field of Search ..... 439/358, 357, 439/350, 353, 354, 489, 488, 595, 378, 351, 352

(56) References Cited

U.S. PATENT DOCUMENTS

| | | | | |
|---|---|---|---|---|
| 4,640,566 | * | 2/1987 | Matsusaka | 439/350 |
| 4,986,766 | | 1/1991 | Leonard et al. | 439/352 |
| 5,246,380 | * | 9/1993 | Kodama | 439/354 |
| 5,254,014 | * | 10/1993 | Yagi et al. | 439/353 |
| 5,378,168 | * | 1/1995 | Sumida | 439/358 |
| 5,775,932 | * | 7/1998 | Saito et al. | 439/378 |
| 6,059,598 | * | 5/2000 | Yamashita et al. | 439/352 |

FOREIGN PATENT DOCUMENTS

| | | |
|---|---|---|
| 56-7287 | 1/1981 | (JP) . |
| 2-112180 | 4/1990 | (JP) . |

* cited by examiner

*Primary Examiner*—Gary Paumen
*Assistant Examiner*—Ross Gushi
(74) *Attorney, Agent, or Firm*—Morgan, Lewis & Bockius LLP

(57) ABSTRACT

A lock structure comprising a male connector housing, a female connector, an elastic lock arm, a lock-retaining portion and a correction portion. The female connector housing is to be fitted with the male connector housing in an opposing manner. The elastic lock arm is provided on one of the male and female connector housings and has a lock projection. The lock-retaining portion is provided on the one of the male and female connector housings that is not provided with the elastic lock arm. The lock projection of the lock arm is engageable with the lock-retaining portion. The correction portion corrects elastic deformation of the lock arm when the male and female connector housings are fitted together.

11 Claims, 9 Drawing Sheets

LOCK STRUCTURE FOR LOCKING MALE AND FEMALE CONNECTOR HOUSINGS TOGETHER

BACKGROUND OF THE INVENTION

1. Field of the Invention

This invention relates to a lock structure for locking or holding a condition in which male and female connector housings mutually fit together.

2. Description of the Related Art

FIG. 13 shows a connector 1 (disclosed in Japanese Utility Model Unexamined Publication No. 56-7287) using a lock device. In this Figure, this connector 1 comprises a male connector housing 2, and a female connector housing 4 having a hood portion 3 into which the male connector housing 2 is inserted and fitted. The male connector housing 2 has an elastic lock arm 6 supported thereon in a cantilever manner on a fitting side 5 of the housing. A lock projection 7 is formed on the lock arm 6 at an intermediate portion thereof, and an operating portion 8 is provided at a free end of the lock arm 6.

A groove 9 for receiving the lock arm 6 is formed in the hood portion 3 of the female connector housing 4, and a retaining member 10, extending between opposite sides of the groove 9, is provided on the hood portion 3. When the male and female connector housings 2 and 4 are fitted together, the lock arm 6 is inserted into the groove 9, and the lock projection 7 engages with the retaining member 10.

In this case, when the male connector housing 2 is inserted into the hood portion 3, the lock projection 7 abuts against the retaining member 10. When the male connector housing 2 is further inserted deep into the hood portion 3, the lock arm 6 is flexed (i.e., elastically deformed) to allow the lock projection 7 to pass the retaining member 10. The lock arm 6 is thereafter restored to its initial position because of its own elasticity, so that the lock projection 7 engages with the retaining member 10. When the lock projection 7 is thus engaged with the retaining member 10, there is achieved a locked condition in which the male and female connector housings 2 and 4 are held in a mutually fitted condition.

However, connectors such as the one shown in FIG. 13 suffer from drawbacks. If the lock arm 6 is kept flexed under the influence of an external force, the lock projection 7 on the lock arm 6 will fail to properly engage with the retaining member 10 when the male connector housing 2 is inserted into the hood portion 3. There may be a sensation of incongruous operation, as compared with an ordinary operation. Additionally, the lock projection 7 will not properly engage with the retaining member 10, even after the lock projection 7 passes the retaining member 10.

SUMMARY OF THE INVENTION

It is therefore an object of this invention to provide a lock structure in which a sensation of good operation can be obtained when achieving a locked condition, and the locking can be effected positively.

According to the invention, there is provided a lock structure comprising a male connector housing, a female connector, an elastic lock arm, a lock-retaining portion and a correction portion. The female connector housing is to be fitted with the male connector housing in an opposing manner. The elastic lock arm is provided on one of the male and female connector housings and has a lock projection. The lock-retaining portion is provided on the one of the male and female connector housings that is not provided with the elastic lock arm. The lock projection of the lock arm is engageable with the lock-retaining portion. The correction portion corrects elastic deformation of the lock arm when the male and female connector housings are fitted together.

In this lock structure, even if the lock arm is elastically deformed upon application of an external force before the male and female connector housings are fitted together, the correction portion corrects the elastic deformation of the lock arm to bring the lock arm into its normal condition when the male and female connector housings are fitted together. As a result, the lock projection properly engages with the lock-retaining portion, thus achieving proper locking. Therefore, a sensation of good operation can be obtained when achieving the locked condition, and a positively-locked condition can be obtained.

The lock arm may be provided on the male connector housing, and the lock-retaining portion provided on a hood portion of the female connector housing, wherein the male connector housing may be inserted and fitted into the hood portion. The correction portion may be provided within said hood portion.

In this lock structure, when the male connector housing is inserted into the hood portion of the female connector housing, the lock projection abuts against the lock-retaining portion, so that the lock arm is flexed. The lock projection therefore passes the lock-retaining portion, and the lock arm is restored to its original position due to its own elasticity. As a results the lock projection is retainingly engaged with the lock-retaining portion, thus achieving the locked condition.

At this time, even if the lock arm is elastically deformed upon application of an external force, the correction portion corrects the elastically-deformed lock arm into its original position when the male and female connector housings are fitted together. The lock arm is therefore properly flexed, so that the lock projection engages with the lock-retaining portion. As a result, a sensation of good operation can be obtained when achieving the locked condition, and a positively-locked condition can be obtained.

The lock structure of the invention may also have the lock arm supported by the male connector housing at an intermediate portion between opposite ends of the lock arm. The lock arm may further comprise a correction receiving portion provided at a front end portion of the lock arm disposed forwardly in a direction of fitting the male connector housing into the female connector housing, wherein the correction receiving portion slides in contact with the correction portion. A lock projection may be formed on a rear end portion of the lock arm.

In this lock structure, when the male connector housing is inserted into the female connector housing, with the lock arm kept elastically deformed upon application of an external force, the correction receiving portion of the lock arm slides in contact with the correction portion, so that the lock arm is corrected into the normal position. As a result, the lock projection is engaged with the lock-retaining portion in a proper condition, and therefore a sensation of good operation can be obtained when achieving the locked condition, and a positively-locked condition can be obtained.

The lock structure of the invention may also have the lock arm supported on the male connector housing through a support portion located at a front end of the lock arm, disposed forwardly in a direction of fitting of the male connector housing into the female connector housing. The correction portion passes through the support portion, and is brought into sliding contact with a flexed surface of the lock arm.

In this lock structure, even if the lock arm, supported in a cantilever manner, is flexed upon application of an external force, the correction portion is brought into sliding contact with the surface of the lock arm facing the flexure space, to return the lock arm into the normal position when the male and female connector housings are fitted together. As a result, a sensation of good operation can be obtained when achieving the locked condition. Also, a positively-locked condition can be obtained.

The lock structure of the invention may also have a lock arm supported on the male connector housing at front and rear ends of the lock arm, respectively disposed forwardly and rearwardly in a direction of fitting the male connector housing into the female connector housing. Also, the correction portion passes through the front support portion, and is brought into sliding contact with a flexed surface of the lock arm.

In this lock structure, even if the lock arm, supported at its opposite ends thereof, is flexed upon application of an external force, the correction portion is brought into sliding contact with the surface of the lock arm that faces the flexure space, to return the lock arm into the normal position when the male and female connector housings are fitted together. As a result, a sensation of good operation can be obtained when achieving the locked condition. Moreover, a positively-locked condition can be obtained.

The lock structure of the invention may also have a lock arm with an abutment projection. The lock arm is provided between a pair of side walls formed on and projecting from an outer surface of the male connector housing, and is supported on the pair of side walls at opposite sides of a front end of the lock arm, disposed forwardly in a direction of fitting of the male connector housing into the female connector housing. The correction portion, when inserted into a space beneath the lock arm, abuts against and is brought into sliding contact with the abutment projection.

In this lock structure, even if the lock arm, supported at its opposite sides on the pair of side walls, is flexed upon application of an external force, the correction portion abuts against and is brought into sliding contact with the abutment projection to correct this elastic deformation when the male and female connector housings are fitted together. As a result, a sensation of good operation can be obtained when the lock projection is locked to the lock-retaining portion.

The entire disclosure of each and every foreign patent application from which the benefit of foreign priority has been claimed in the present application is incorporated herein by reference, as if fully set forth.

DETAILED DESCRIPTION OF THE PREFERRED EMBODIMENT

Preferred embodiments of the lock structure of the present invention will now be described with reference to the accompanying drawings.

Figure 2A:
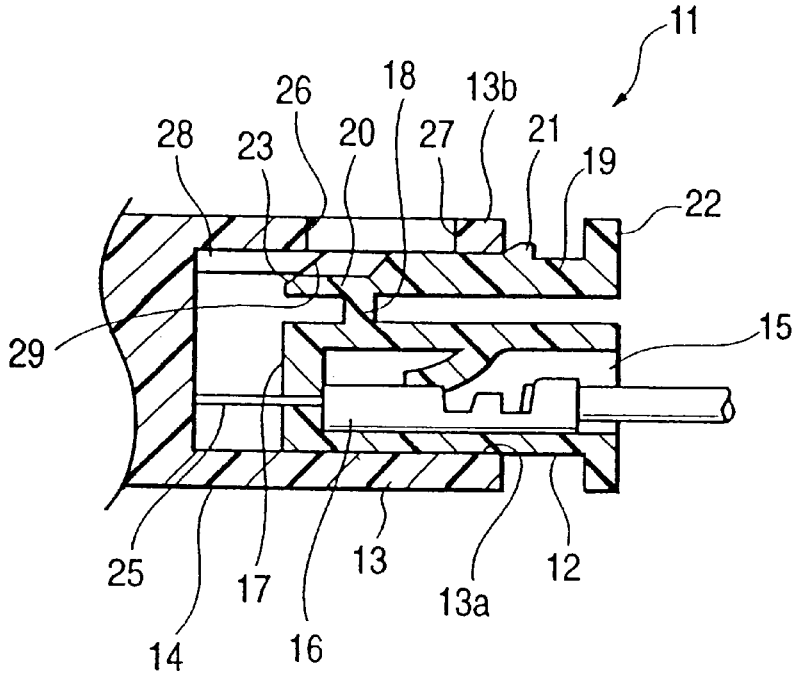
FIG. 2A is a cross-sectional view of the connector of the first embodiment, showing the process of inserting and fitting the male connector housing into a hood portion of the female connector housing.
Figure 2B:
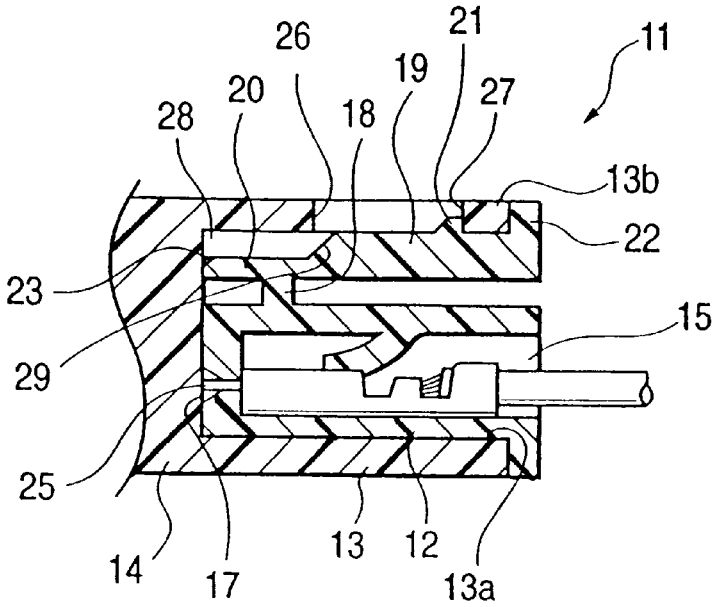
FIG. 2B is a cross-sectional view showing a condition in which the male connector housing is completely inserted and fitted in the hood portion.
Figure 3:
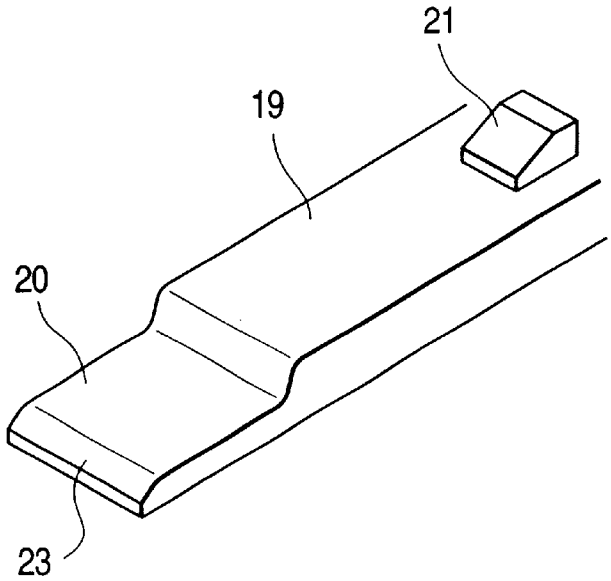
FIG. 3 is a perspective view showing an end portion of the lock arm of the connector of the first embodiment.

FIGS. 1 to 4 show a first embodiment of a connector 11 using a lock structure of the invention. As shown in FIG. 1, the connector 11 comprises a male connector housing 12, and a female connector housing 14 having a hood portion 13 into which the male connector housing 12 is inserted and fitted. Terminal receiving chambers 15 are formed within the male connector housing 12, and female terminals 16 are received in these terminal receiving chambers 15, respectively. An elastic lock arm 19 is integrally formed on a portion of the male connector housing 12 via a support portion 18 near a fitting side 17, to be inserted into the hood portion 13. A correction receiving portion 20 is formed at one end portion of the lock arm 19. A lock projection 21 is formed on that portion of the lock arm 19, and is disposed rearwardly of the correction receiving portion 20 and the support portion 18. An operating portion 22 is formed at an end of the lock arm 19 at the side of the lock projection 21. As shown in FIG. 3, the correction receiving portion 20 has a small thickness and a slanting surface 23 formed at an end thereof.

The correction receiving portion 20 has a small thickness, and therefore even if the lock arm 19 is flexed or elastically deformed upon application of an external force, the male connector housing 12 can be inserted into the hood portion 13. In other words, if the height of the male connector housing 12 is equal to an internal dimension of the hood portion 13, the male connector housing 12 can not be inserted into the hood portion 13 when the lock arm 19 is flexed. However, the small thickness of the correction receiving portion 20 enables the male connector housing 12 to be inserted into the hood portion 13 even when the lock arm 19 is flexed. Thus, an effective relief can be achieved by the thin correction receiving portion 20.

Male terminals 24 are received in the female connector housing 14, and contact portions 25 of these male terminals 24 project into the interior of the hood portion 13. When the male connector housing 12 is inserted and fitted into the hood portion 13, the female terminals 16 are connected to the contact portions 25, respectively. A hole 26 formed through a wall of the hood portion 13 communicates the interior and exterior of the hood portion 13. A portion of an inner peripheral edge of the hole 26 serves as a lock-retaining portion 27. When the male connector housing 12 is inserted and fitted into the hood portion 13, the lock projection 21 of the male connector housing 12 engages with the lock-retaining portion 27.

A correction portion 28 is formed on an inner portion of the hood portion 13. The correction portion 28 extends from an inner end (or bottom) of the hood portion 13 toward an open end (outer end) 13*a* thereof, and a slanting surface 29, slanting upwardly toward the hole 26, is formed at an end of the correction portion 28. When the male connector housing 12 is inserted into the hood portion 13, the correction receiving portion 20 of the lock arm 19 is brought into sliding contact with the correction portion 28.

Figure 1A:
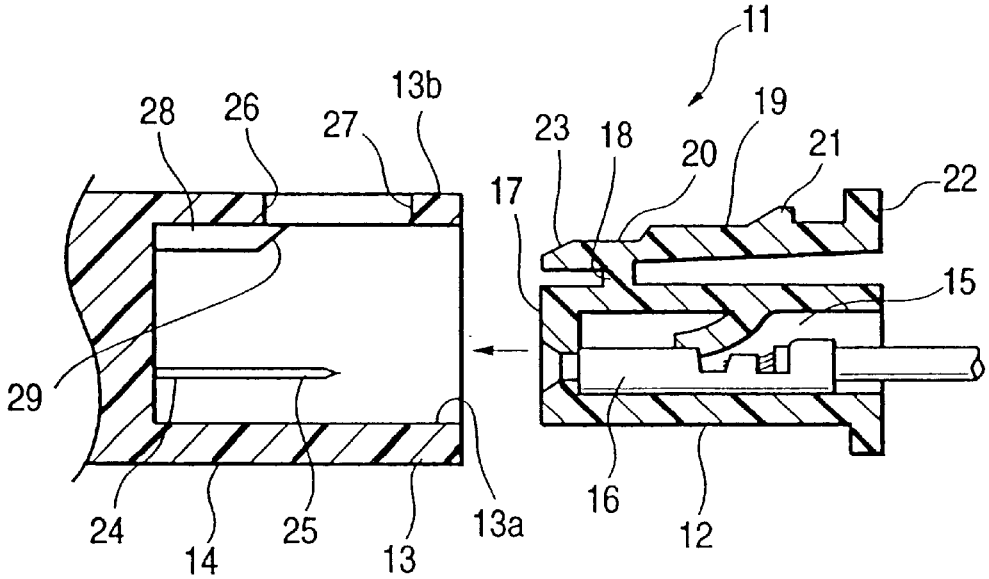
FIG. 1A is a cross-sectional view of a first embodiment of a connector of the invention, showing a condition before male and female connector housings are fitted together.

As shown in FIG. 1A, when the male connector housing 12 is inserted into the hood portion 13 with the lock arm 19 disposed in the normal position (i.e., not flexed), the lock projection 21 abuts against an edge 13*b* of the open end of the hood portion 13. When the male connector housing 12 is further inserted into the hood portion 13, the support portion 18 is flexed, so that the lock arm 19 is pivotally moved about the support portion 18. Then the lock projection 21 passes the opening edge 13*b* of the hood portion 13. When the lock projection 21 thus passes the opening edge 13*b* of the hood portion 13, the lock arm 19 is restored to its normal position due to the elastic force of the support portion 18. The lock projection 21 is then fitted into the hole 26 to engage the lock-retaining portion 27, as shown in FIG. 2B.

Figure 1B:
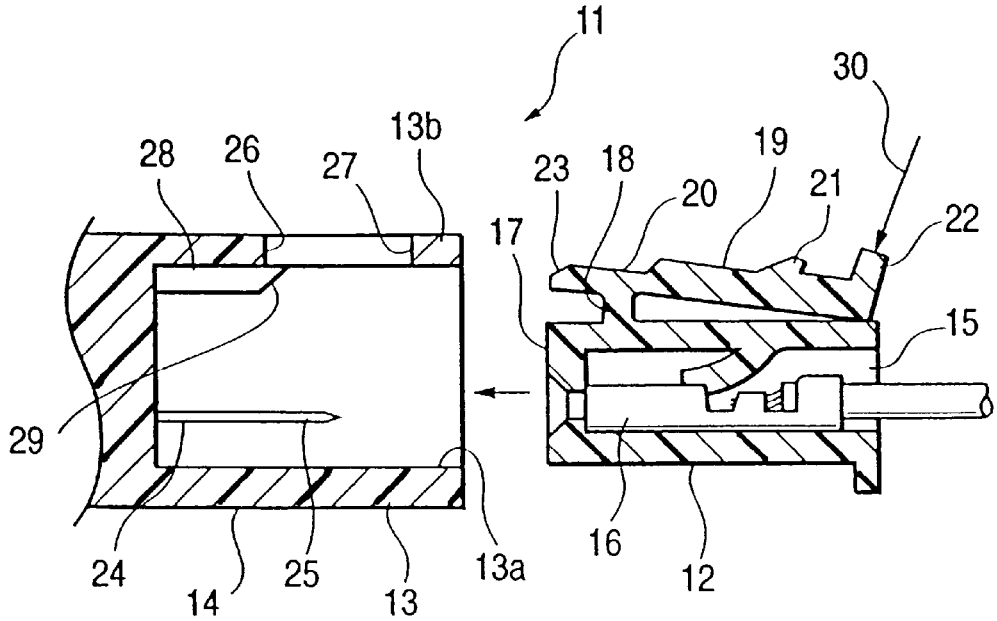
FIG. 1B is a cross-sectional view showing a condition in which a lock arm is elastically deformed upon application of an external force thereto.

As shown in FIG. 1B, when the male connector housing 12 is inserted into the hood portion 13, with the lock arm 19 disposed out of the normal position upon application of an external force 30 thereto, the correction receiving portion 20 slides in contact with the correction portion 28 as shown in FIG. 2A, thereby correcting the lock arm 19 into the normal position. Under this condition, when the male connector housing 12 is further inserted into the hood portion 13, the lock projection 21 engages with the lock-retaining portion 27, thereby achieving the locked condition, as shown in FIG. 2B.

In this embodiment, even if the lock arm 19 is flexed upon application of an external force 30, the correction portion 28 slides the correction receiving portion 20 when the male connector housing 12 is inserted into the hood portion 13. The flexing of the lock arm 19 is thereby corrected. As a result, a user can experience a sense of good operation while achieving the locked condition. Additionally, the locked condition can be positively obtained.

Figure 4:
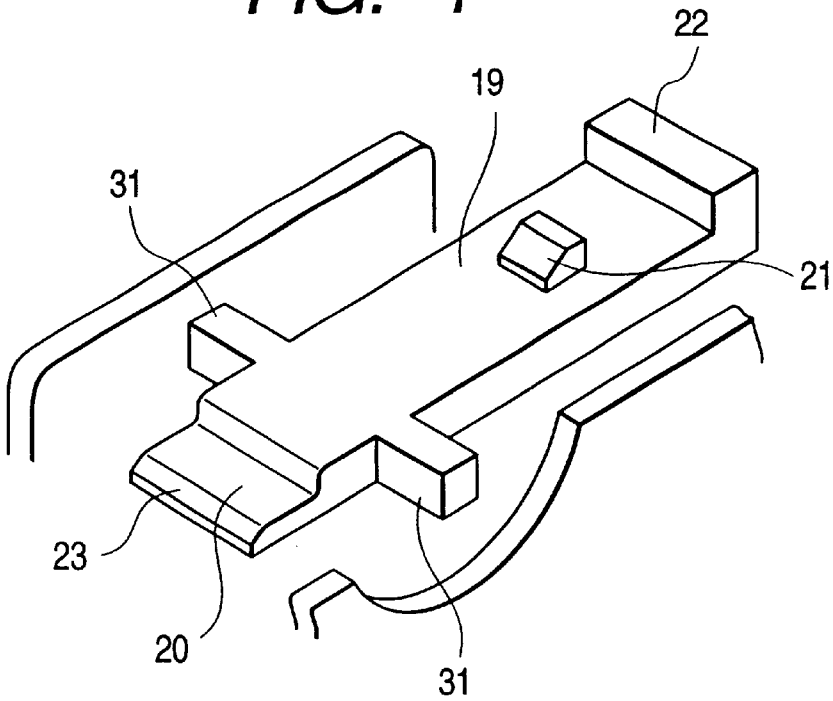
FIG. 4 is a perspective view showing a modified lock arm of the connector of the first embodiment.

In this first embodiment, the lock arm 19 is formed integrally with the male connector housing 12 through the support portion 18 formed on and projecting from the upper surface of the male connector housing 12. Alternatively, as shown in FIG. 4, there may be used an arrangement in which the lock arm 19 is molded integrally with the male connector housing 12 through support arms 31 and 31 extending respectively from the opposite sides (i.e., side edges) of the lock arm 19.

Next, a second embodiment will be described with reference to FIGS. 5A and 5B. A connector 32 of this embodiment differs from the connector of the preceding embodiment in that a male connector housing 33 has a lock arm 34 of a different shape. More specifically, in the preceding embodiment, as shown in FIG. 1, the lock arm 19 is supported at an intermediate portion thereof by the support portion 18, and therefore is the so-called see-saw type lock arm. On the other hand, the lock arm 34 of this embodiment is the cantilever-type lock arm, which extends from a fitting side 17 of the male connector housing 33.

Figure 5A:
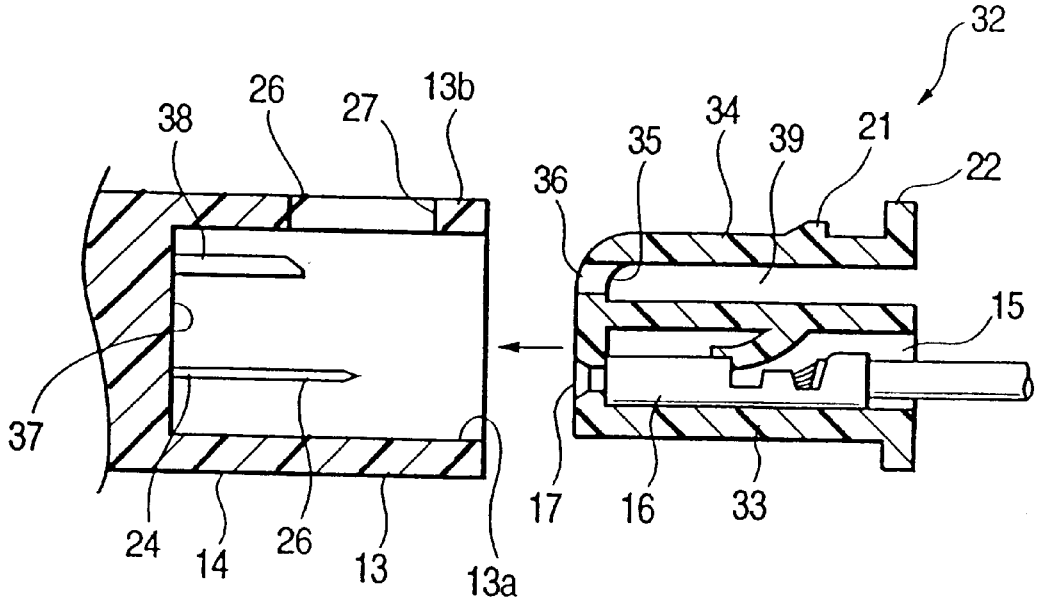
FIG. 5A is a cross-sectional view of a second embodiment of a connector of the invention, showing a condition before a male connector housing is inserted and fitted into a hood portion.
Figure 5B:
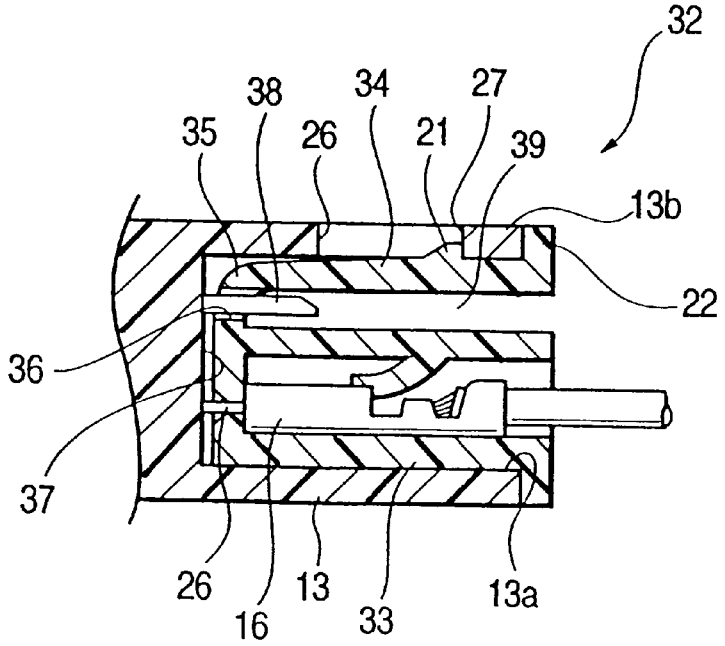
FIG. 5B is a cross-sectional view showing a condition in which the male connector housing is completely inserted and fitted into the hood portion.

As shown in FIGS. 5A and 5B, the lock arm 34 in this embodiment is formed integrally on the male connector housing 33 at the fitting side 17 through a support portion 35, and is supported in a cantilever manner. A correction portion insertion hole 36 is formed through the support portion 35.

A correction portion 38 is formed on and extends from a bottom (i.e., inner end) 37 of a hood portion 13 of a female connector housing 14. When the male connector housing 33 is inserted into the hood portion 13, the correction portion 38 passes through the correction portion insertion hole 36, and is brought into sliding contact with that surface of the lock arm 34 in a flexure space 39.

When the male connector housing 33 is inserted into the hood portion 13 while the lock arm 34 is flexed (or elastically deformed) by an external force, the correction portion 38 passes through the correction portion insertion hole 36, and slides in contact with the surface of the lock arm 34 in the flexure space 39. The elastic deformation of the lock arm 34 is thereby corrected. As a result, the lock arm 34 is inserted in its normal condition into the hood portion 13, and therefore a sensation of good operation can be obtained when a lock projection 21 is locked to a lock-retaining portion 27. Additionally, the locked condition can be positively achieved.

Next, a third embodiment will be described with reference to FIGS. 6A and 6B. A connector 41 of this embodiment differs from the connectors of the first and second embodiments in that a lock arm 43 of a male connector housing 42 is supported at opposite ends thereof.

Figure 6A:
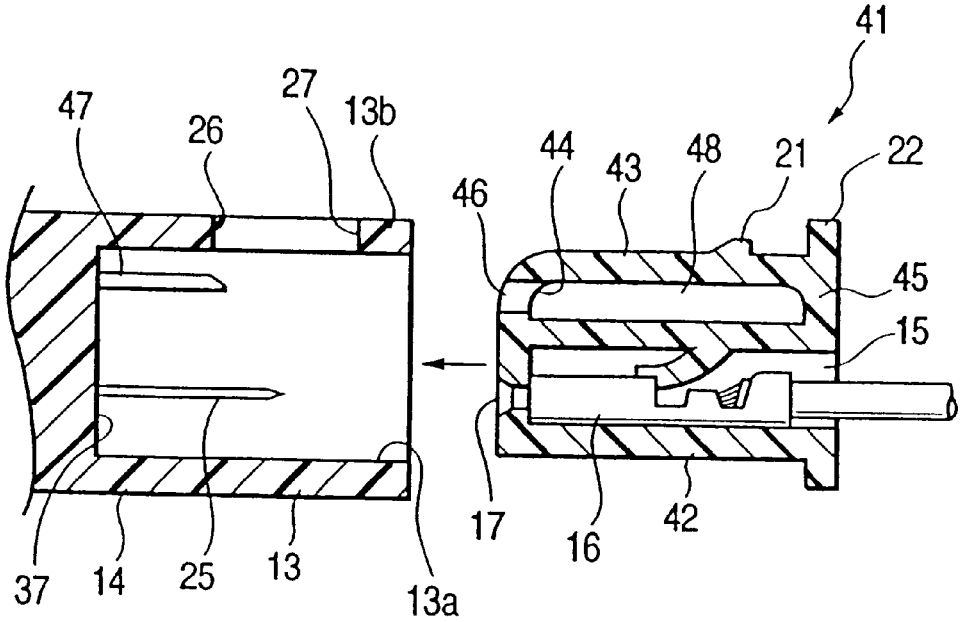
FIG. 6A is a cross-sectional view of a third embodiment of a connector of the invention, showing a condition before a male connector housing is inserted and fitted into a hood portion.
Figure 6B:
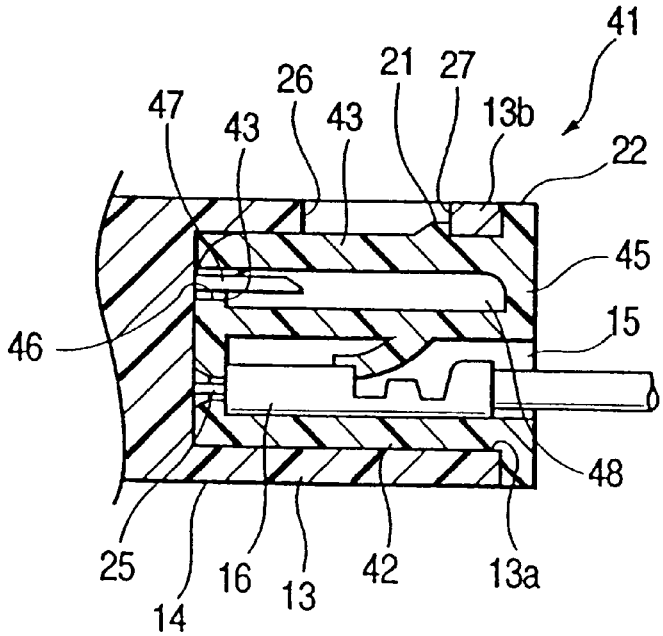
FIG. 6B is a cross-sectional view showing a condition in which the male connector housing is completely inserted and fitted into the hood portion.

As shown in FIG. 6A, the lock arm 43 in this embodiment is formed integrally on the male connector housing 42 through a front support portion 44 and a rear support portion 45. The front support portion 44 (disposed at a fitting side 17) is disposed forwardly in a direction of fitting of the male connector housing 42 into a hood portion 13, and the rear support portion 45 is disposed rearwardly in the fitting direction. A correction portion insertion hole 46 is formed through the front support portion 44.

A correction portion 47 is formed on and extends from a bottom (i.e., inner end) 37 of the hood portion 13 of a female connector housing 14. When the male connector housing 42 is inserted into the hood portion 13, the correction portion 47 passes through the correction portion insertion hole 46, formed through the front support portion 44, and is brought into sliding contact with the surface of the lock arm 43 facing a flexure space 48.

When the male connector housing 42 is inserted into the hood portion 13, with the lock arm 43 kept flexed (or elastically deformed) by an external force, the correction portion 47 passes through the correction portion insertion hole 46, and slides in contact with the surface of the lock arm 43 in the flexure space 48. The elastic deformation of the lock arm 43 is thereby corrected. As a result, the lock arm 43 is inserted in its normal condition into the hood portion, and therefore a sensation of good operation can be obtained when a lock projection 21 is locked to a lock-retaining portion 27. Moreover, the locked condition can be positively achieved.

Next, a fourth embodiment will be described with reference to FIGS. 7 to 12. A connector 51 of this embodiment comprises a male connector housing 52, and a female connector housing 54 having a hood portion 53 into which the male connector housing 52 is inserted and fitted. As in the above embodiments, a plurality of terminal receiving chambers 55 (see FIG. 11) are formed within the male connector housing 52, and female terminals (not shown) are received in these terminal receiving chambers, respectively.

Figure 11:
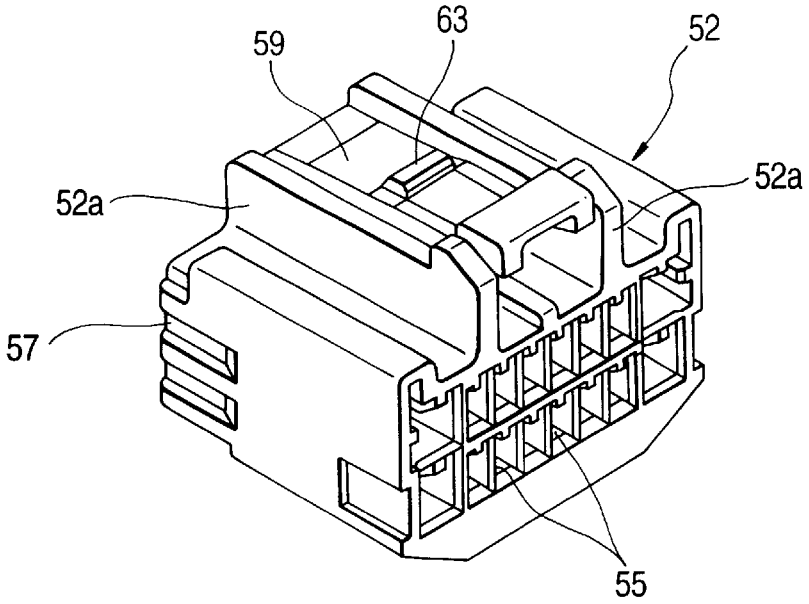
FIG. 11 is a perspective view showing the male connector housing of the fourth embodiment.
Figure 13:
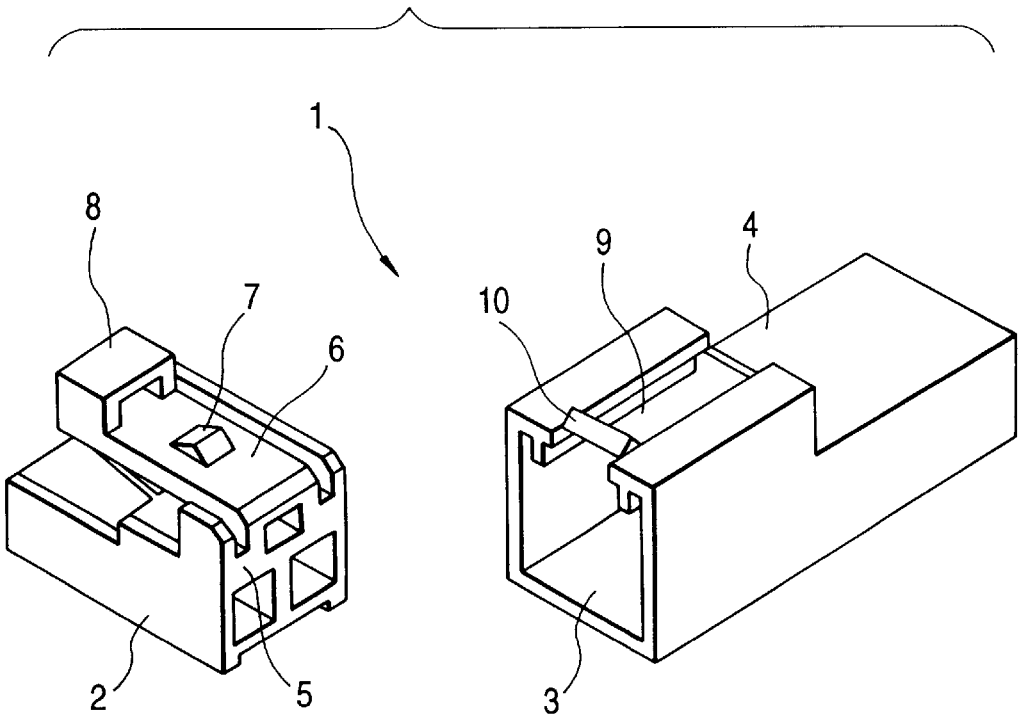
FIG. 13 is a perspective view of a related connector.
Figure 12A:
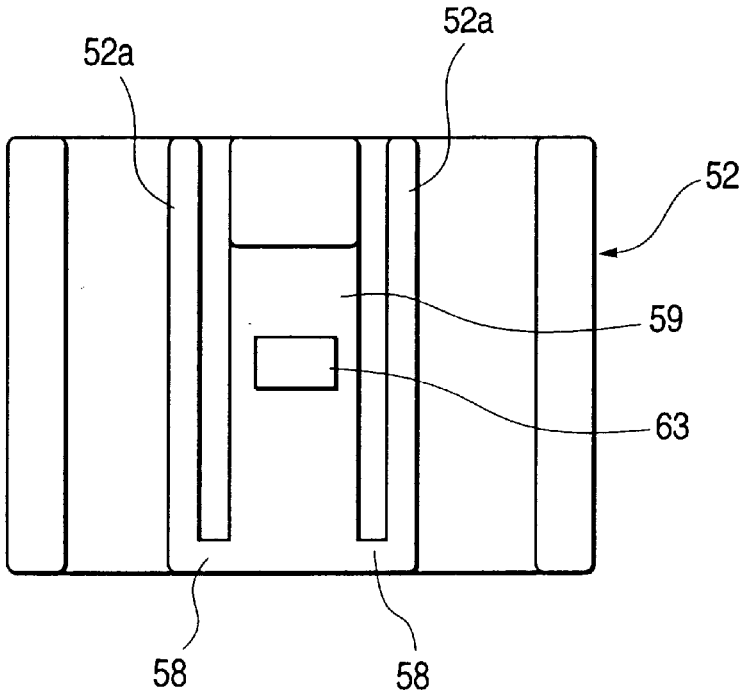
FIG. 12A is a plan view of the male connector housing of the fourth embodiment.
Figure 12B:
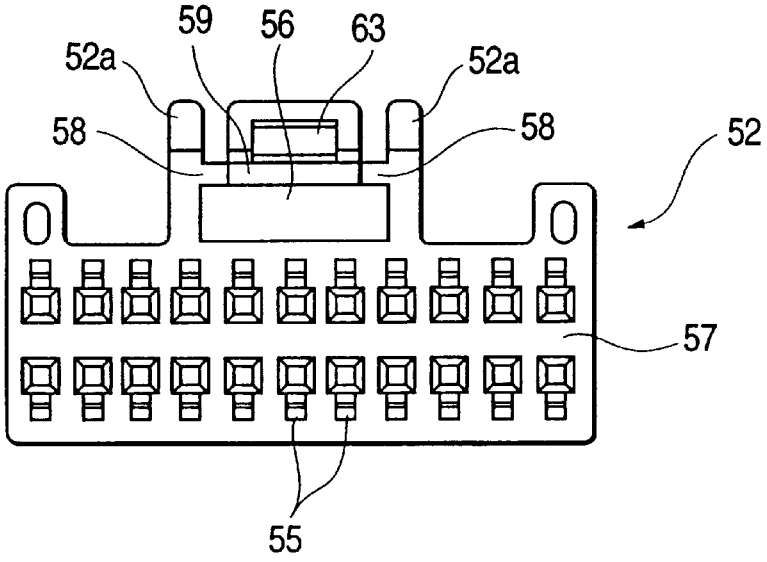
FIG. 12B is a front-elevational view of the male connector housing of the fourth embodiment.

As shown in FIGS. 11 and 12, a pair of side walls 52*a* and 52*a* is formed and projects from an outer surface of the male connector housing 52. The side walls 52*a* and 52*a* are spaced at a predetermined distance from each other. A lock arm 59 is provided between the two side walls 52*a* and 52*a*. The lock arm 59 is supported integrally on the pair of side walls 52*a* and 52*a* through support arms 58 and 58 (see FIG. 12) at a front end of the pair of side walls 52*a* and 52*a* disposed forwardly in a direction of fitting the male connector housing 52 into the female connector housing 54. The support arms 58 and 58 are formed respectively on opposite sides (i.e., side edges) of the lock arm 59. Therefore, like the lock arm 34 of the second embodiment, this lock arm 59 is of the cantilever type. A space beneath the lock arm 59, provided between the pair of side walls 52*a* and 52*a*, serves a flexure space 56 for the lock arm 59. A front end of the flexure space 56 is open and disposed forwardly in the direction of fitting the male connector housing 52 into the female connector housing 54. An abutment projection 60 of an arc shape (See FIGS. 7 to 9) is formed on the lower surface of the lock arm 59 facing the flexure space 56.

Like the female connector housing 14 of the first embodiment, the female connector housing 54 has male terminals received therein (not shown), and contact portions of these male terminals project into the interior of the hood portion 53. When the male connector housing 52 is inserted and fitted into the hood portion 53, the female terminals in the male connector housing 52 are connected to the contact portions, respectively. A hole 61 is formed through a wall of the hood portion 53, and communicates the interior and exterior of the hood portion 53 with each other. A portion of an inner peripheral edge of the hole 61 serves as a lock-retaining portion 62. When the male connector housing 52 is inserted and fitted into the hood portion 53, a lock projection 63 on the male connector housing 52 engages with the lock-retaining portion 62.

Figure 9:
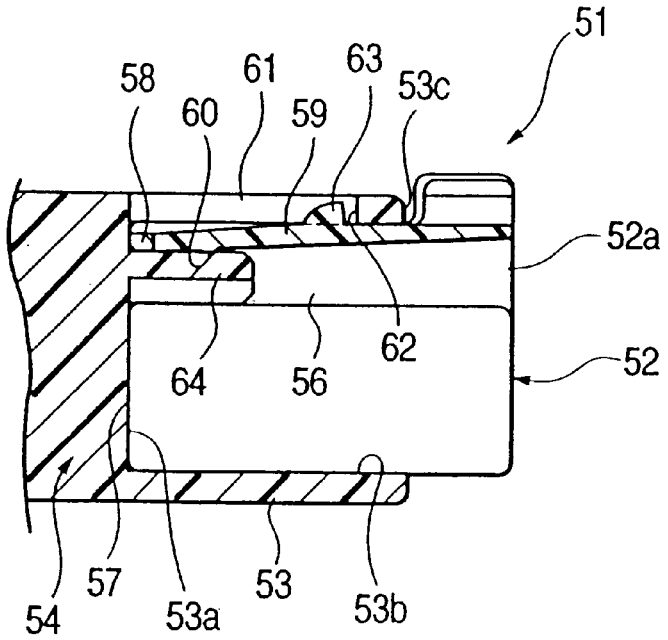
FIG. 9 is a cross-sectional view showing a condition in which a male connector housing of the connector of the fourth embodiment is completely fitted into a hood portion of a female connector housing.
Figure 10:
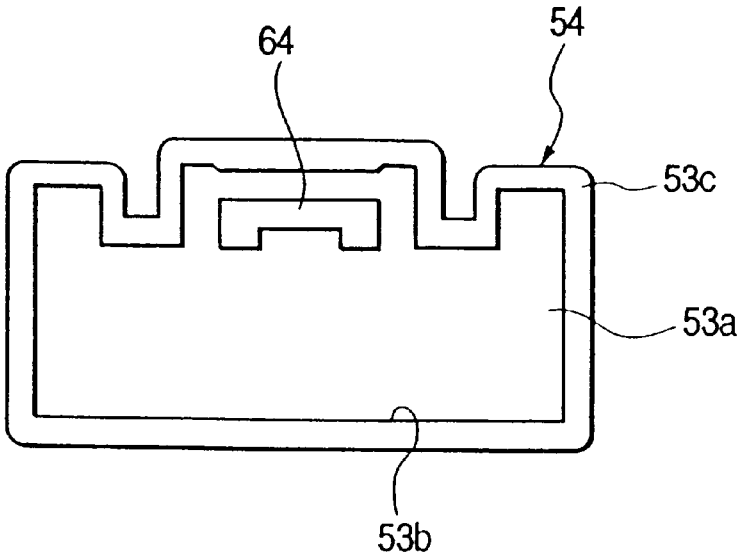
FIG. 10 is a front-elevational view showing the female connector housing of the fourth embodiment.

A correction portion 64 of a downwardly-open channel-shaped cross-section is formed on and extends from a bottom (i.e., inner end) of the hood portion 53 toward an open end 53*b* thereof. A length of the correction portion 64 extending to the open end is determined so that an intermediate portion of the lock arm 59 can be flexed (i.e., elastically deformed) when the lock projection 63 is engaged with the lock-retaining portion 62. Therefore, as shown in FIG. 9, the length of the correction portion 64 is about a half of the distance between the bottom 53*a* of the hood portion 53 and the lock projection 63 of the lock arm 59.

Figure 7:
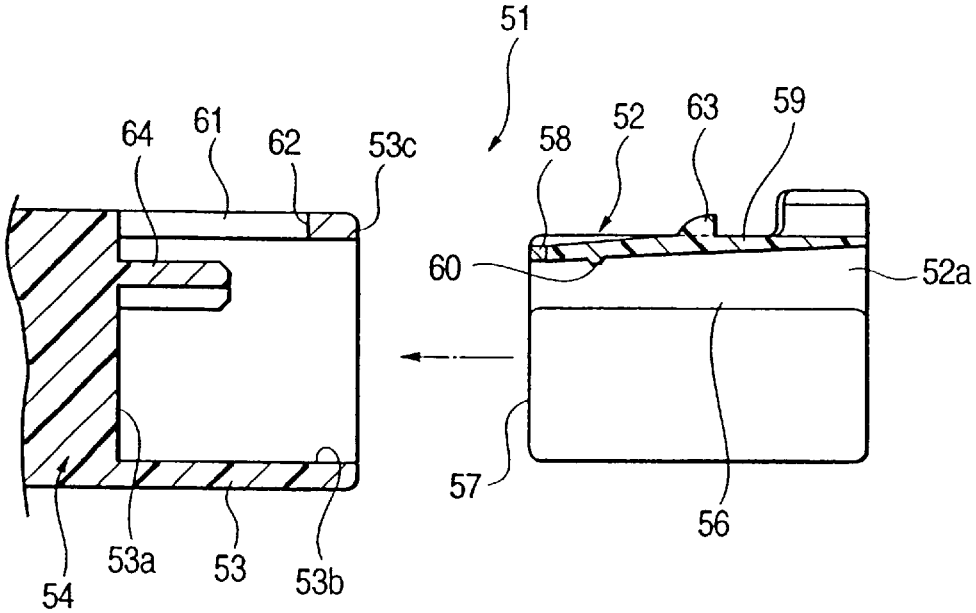
FIG. 7 is a cross-sectional view showing a fourth embodiment of a connector of the invention.

As shown in FIG. 7, when the male connector housing 52 is inserted into the hood portion 53, with the lock arm 59 disposed in its normal position, the lock projection 63 abuts against an edge 53*c* of the open end of the hood portion 53. When the male connector housing 52 is further inserted into the hood portion 53, the support arms 58 and 58 are flexed, so that the lock arm 59 is pivotally moved about the support arms 58 and 58, and the lock projection 63 passes the opening edge 53*c* of the hood portion 53. When the lock projection 63 thus passes the opening edge 53*c* of the hood portion 53, the lock arm 59 is restored to its normal position because of the elastic force of the support arms 58 and 58. The lock projection 63 is fitted into the hole 61 to engage the lock-retaining portion 62, as shown in FIG. 9.

Figure 8:
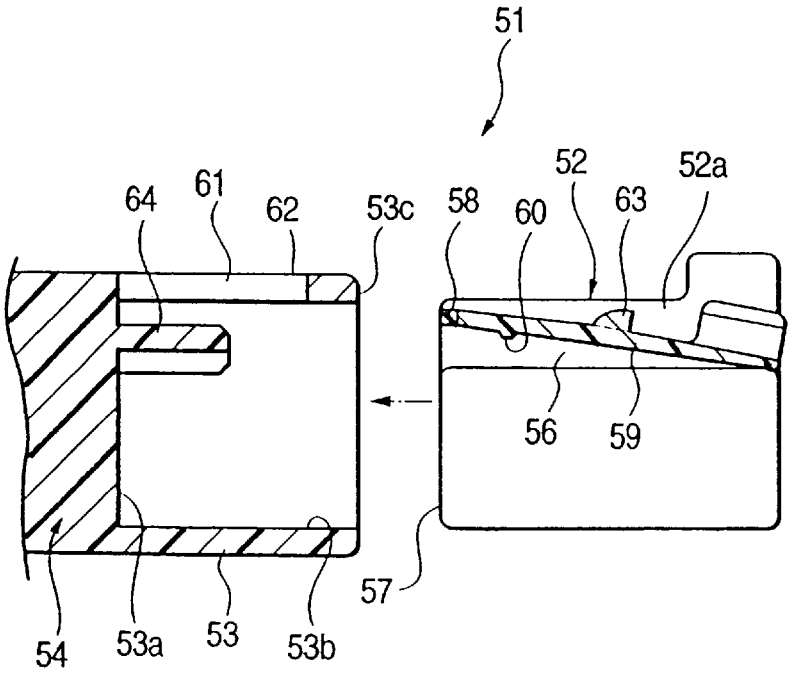
FIG. 8 is a cross-sectional view of the connector of the fourth embodiment, showing a condition in which a lock arm is flexed upon application of an external force.

As shown in FIG. 8, when the male connector housing 52 is inserted into the hood portion 53, with the lock arm 59 disposed out of the normal position upon application of an external force thereto, the end of the correction portion 64 abuts against the abutment projection 60. When the male connector housing 52 is further inserted into the hood portion 53, the correction portion 64 slides in contact with the abutment projection 60, thereby correcting the lock arm 59 into the normal position. In this condition, when the male connector housing 52 is further inserted into the hood portion 53, the lock projection 63 engages with the lock-retaining portion 62, thereby achieving the locked condition, as shown in FIG. 9.

In this embodiment, even if the lock arm 59 is flexed due to an application of an external force, the correction portion 64 is brought into sliding contact with the abutment projection 60 when the male connector housing 52 is inserted into the hood portion 33. The flexing of the lock arm 59 is thus corrected. As a result, a sensation of good operation can be obtained when the lock projection 63 is locked to the lock-retaining portion 62. Moreover, the locked condition can be positively obtained.

As shown in FIG. 9, when the male connector housing 52 is completely fitted into the hood portion 53, the correction portion 64 supports the lower surface of the lock arm 59.

As described above, according to the present invention, even if the lock arm is elastically deformed upon application of an external force before the male and female connector housings are fitted together, the correction portion corrects the elastic deformation of the lock arm to bring the lock arm into its normal condition when the male and female connector housings are fitted together. As a result, the lock projection properly engages with the lock-retaining portion, thus achieving the proper locking. Therefore, a sensation of good operation can be obtained when achieving the locked condition. Also, the positively-locked condition can be obtained.

Moreover, even if the lock arm is elastically deformed upon application of an external force, the correction portion corrects the elastically-deformed lock arm into its original position when the male and female connector housings are fitted together. Therefore, the lock arm is properly flexed, so that the lock projection engages with the lock-retaining portion. Therefore, a use may experience a sense of good operation when achieving the locked condition. Also, the locked condition can be positively obtained.

In addition to the above effects, when the male connector housing is inserted into the female connector housing, with the lock arm kept elastically deformed upon application of an external force, the correction receiving portion of the lock arm slides in contact with the correction portion, so that the lock arm is corrected into the normal position. As a result, the lock projection engages with the lock-retaining portion in a proper condition, and therefore a sensation of good operation can be obtained when achieving the locked condition, and the locked condition can be positively obtained.

As described in another embodiment, even if the lock arm, supported in a cantilever manner, is flexed upon application of an external force, the correction portion is brought into sliding contact with the surface of the lock arm, facing the flexure space, to return the lock arm into the normal position when the male and female connector housings are fitted together. As a result, a sensation of good operation can be obtained when achieving the locked condition, and the locked condition can be positively obtained.

Moreover, even if the lock arm, supported at opposite ends thereof, is flexed upon application of an external force, the correction portion is brought into sliding contact with the surface of the lock arm, facing the flexure space, to return the lock arm into the normal position when the male and female connector housings are fitted together. As a result, a sensation of good operation can be obtained when achieving the locked condition, and the locked condition can be positively obtained.

In addition, even if the lock arm, supported at opposite sides on the pair of side walls, is flexed upon application of an external force, the correction portion abuts against and is brought into sliding contact with the abutment projection to correct this elastic deformation when the male and female connector housings are fitted together. As a result, a sensation of good operation can be obtained when the lock projection is locked to the lock-retaining portion.

While only certain embodiments of the invention have been specifically described herein, it will be apparent that numerous modifications may be made thereto without departing from the spirit and scope of the invention.

What is claimed is:

1. A lock structure comprising:

a male connector housing;

a female connector housing to be fitted with said male connector housing in an opposing manner;

an elastic lock arm provided on one of said male and female connector housings and having a lock projection;

a lock-retaining portion provided on the one of said male and female connector housings that is not provided with said elastic lock arm, wherein the lock projection of said lock arm is engageable with said lock-retaining portion; and a correction portion for contacting said lock arm and correcting elastic deformation of said lock arm to guide the lock projection in a direction towards the lock-retaining portion, when said male and female connector housings are fitted together, wherein:

said lock arm is provided on said male connector housing;

said lock-retaining portion is provided on a hood portion of said female connector housing, wherein said male connector housing is insertable and fittable into the hood portion; and said correction portion is provided within said hood portion.

2. The lock structure according to claim 1, wherein said lock arm is supported by said male connector housing at an intermediate portion located between opposite ends of said lock arm; and wherein said lock arm further comprises:

a correction receiving portion provided at a front end portion of said lock arm disposed forwardly in a direction of fitting said male connector housing into said female connector housing, wherein said correction receiving portion slides in contact with said correction portion; and wherein the lock projection is formed on a rear end portion of said lock arm.

3. The lock structure according to claim 1, wherein:

said lock arm is supported on said male connector housing through a support portion located at a front end of said lock arm, disposed forwardly in a direction of fitting of said male connector housing into said female connector housing; and said correction portion passes through said support portion, and is brought into sliding contact with a flexed surface of said lock arm.

4. The lock structure according to claim 1, wherein:

said lock arm is supported on said male connector housing at front and rear ends of said lock arm, respectively disposed forwardly and rearwardly in a direction of fitting of said male connector housing into said female connector housing; and said correction portion passes through the front support portion, and is brought into sliding contact with a flexed surface of said lock arm.

5. The lock structure according to claim 1, wherein:

said lock arm further comprises an abutment projection;

said lock arm is provided between a pair of side walls formed on and projecting from an outer surface of said male connector housing, and is supported on said pair of side walls at opposite sides of a front end of said lock arm, disposed forwardly in a direction of fitting of said male connector housing into said female connector housing; and said correction portion, when inserted into a space beneath said lock arm, abuts against and is brought into sliding contact with said abutment projection.

6. A lock structure comprising:

a male connector housing;

a female connector housing to be fitted with said male connector housing in an opposing manner;

an elastic lock arm provided on one of said male and female connector housings and having a lock projection;

a lock-retaining portion provided on the one of said male and female connector housings that is not provided with said elastic lock arm, wherein the lock projection of said lock arm is engageable with said lock-retaining portion; and a correction portion for contacting said lock arm and correcting elastic deformation of said lock arm to guide the lock projection in a direction towards the lock-retaining portion, when said male and female connector housings are fitted together, wherein said lock arm is supported by said male connector housing at an intermediate portion between opposite ends of said lock arm; and wherein said lock arm further comprises:

a correction receiving portion provided at a front end portion of said lock arm disposed forwardly in a direction of fitting said male connector housing into said female connector housing, wherein said correction receiving portion slides in contact with said correction portion; and wherein the lock projection is formed on a rear end portion of said lock arm.

7. A lock structure comprising:

a male connector housing;

a female connector housing to be fitted with said male connector housing in an opposing manner;

an elastic lock ann provided on one of said male and female connector housings and having a lock projection;

a lock-retaining portion provided on the one of said male and female connector housings that is not provided with said elastic lock arm, wherein the lock projection of said lock arm is engageable with said lock-retaining portion; and a correction portion for contacting said lock arm and correcting elastic deformation of said lock arm to guide the lock projection in a direction towards the lock-retaining portion, when said male and female connector housings are fitted together, wherein:

said lock arm is supported on said male connector housing through a support portion located at a front end of said lock arm, disposed forwardly in a direction of fitting of said male connector housing into said female connector housing; and said correction portion passes through said support portion, and is brought into sliding contact with a flexed surface of said lock arm.

8. A lock structure comprising:

a male connector housing;

a female connector housing to be fitted with said male connector housing in an opposing manner;

an elastic lock arm provided on one of said male and female connector housings and having a lock projection;

a lock-retaining portion provided on the one of said male and female connector housings that is not provided with said elastic lock arm, wherein the lock projection of said lock arm is engageable with said lock-retaining portion; and a correction portion for contacting said lock arm and correcting elastic deformation of said lock arm to guide the lock projection in a direction towards the lock-retaining portion, when said male and female connector housings are fitted together, wherein:

said lock arm is supported on said male connector housing at front and rear ends of said lock arm, respectively disposed forwardly and rearwardly in a direction of fitting said male connector housing into said female connector housing; and said correction portion passes through the front support portion, and is brought into sliding contact with a flexed surface of said lock arm.

9. A lock structure comprising:

a male connector housing;

a female connector housing to be fitted with said male connector housing in an opposing manner;

an elastic lock arm provided on one of said male and female connector housings and having a lock projection;

a lock-retaining portion provided on the one of said male and female connector housings that is not provided with said elastic lock arm, wherein the lock projection of said lock arm is engageable with said lock-retaining portion; and a correction portion for contacting said lock arm and correcting elastic deformation of said lock arm to guide the lock projection in a direction towards the lock-retaining portion, when said male and female connector housings are fitted together, wherein:

said lock arm further comprises an abutment projection;

said lock arm is provided between a pair of side walls formed on and projecting from an outer surface of said male connector housing, and is supported on said pair of side walls at opposite sides of a front end of said lock arm, disposed forwardly in a direction of fitting of said male connector housing into said female connector housing; and said correction portion, when inserted into a space beneath said lock arm, abuts against and is brought into sliding contact with said abutment projection.

10. A lock structure comprising:

a male connector housing;

a female connector housing to be fitted with said male connector housing in an opposing manner;

an elastic lock arm provided on one of said male and female connector housings and having a lock projection;

a lock-retaining portion provided on the one of said male and female connector housings that is not provided with said elastic lock arm, wherein the lock projection of said lock arm is engageable with said lock-retaining portion; and a correction portion for correcting elastic deformation of said lock arm when said male and female connector housings are fitted together, wherein:

said lock arm further comprises an abutment projection;

said lock arm is provided between a pair of side walls formed on and projecting from an outer surface of said male connector housing, and is supported on said pair of side walls at opposite sides of a front end of said lock arm, disposed forwardly in a direction of fitting of said male connector housing into said female connector housing; and said correction portion, when inserted into a space beneath said lock arm, abuts against and is brought into sliding contact with said abutment projection.

11. A lock structure comprising:

a male connector housing;

a female connector housing to be fitted with said male connector housing in an opposing manner;

an elastic lock arm provided on one of said male and female connector housings and having a lock projection;

a lock-retaining portion provided on the one of said male and female connector housings that is not provided with said elastic lock arm, wherein the lock projection of said lock arm is engageable with said lock-retaining portion; and a correction portion for correcting elastic deformation of said lock arm when said male and female connector housings are fitted together, wherein:

said lock arm is provided on said male connector housing;

said lock-retaining portion is provided on a hood portion of said female connector housing, wherein said male connector housing is insertable and fittable into the hood portion;

said correction portion is provided within said hood portion;

said lock arm further comprises an abutment projection;

said lock arm is provided between a pair of side walls formed on and projecting from an outer surface of said male connector housing, and is supported on said pair of side walls at opposite sides of a front end of said lock arm, disposed forwardly in a direction of fitting of said male connector housing into said female connector housing; and said correction portion, when inserted into a space beneath said lock arm, abuts against and is brought into sliding contact with said abutment projection.

* * * * *